US005288178A

United States Patent [19]

Pienaar

[11] Patent Number: 5,288,178

[45] Date of Patent: Feb. 22, 1994

[54] PRELOAD HEADBOARD FOR AN ELONGATE PROP

[75] Inventor: Frans R. P. Pienaar, Krugersdorp, South Africa

[73] Assignee: HL&H Timber Products (PTY) Ltd., Johannesburg, South Africa

[21] Appl. No.: 995,646

[22] Filed: Dec. 18, 1992

[30] Foreign Application Priority Data

Dec. 18, 1991 [ZA] South Africa ..... 91/9946

[51] Int. Cl.[5] ..... E21D 15/55

[52] U.S. Cl. ..... 405/288; 405/289; 405/302.1

[58] Field of Search ..... 405/288, 290, 289, 302.1, 405/302.3

[56] References Cited

U.S. PATENT DOCUMENTS 4,12,693 9/1978 Collin et al. ..... 405/302.1
3,224,202 12/1965 Durget ..... 405/302.1
3,521,454 7/1970 Dodds ..... 405/302.1 X
4,465,405 8/1984 Durfeld ..... 405/289
5,149,228 9/1992 Pienaar et al. ..... 405/289

*Primary Examiner*—David H. Corbin

[57] ABSTRACT

The invention concerns a prop headboard (10) which is used in conjunction with an elongate mine prop. The headboard supports a preload bag (50) inflatable with a settable grout. The headboard is composed of a headboard member (12) and a pot (34). The headboard member includes a pressed steel sheet (14) having relatively higher end regions (16) and a relatively lower central region (22). The central region is formed with an opening (24). The headboard member also has bag retaining formations (30) which receive opposite ends of a preload bag located on the headboard member. The pot is engaged in the opening in the central region and receives the upper end of an elongate prop, thus supporting the headboard member on the prop with the headboard member extending transversely to the prop.

6 Claims, 1 Drawing Sheet

PRELOAD HEADBOARD FOR AN ELONGATE PROP

BACKGROUND TO THE INVENTION

THIS invention relates to a preload headboard for an elongate prop.

In underground mine stoping practice, elongate props, typically having timber as their major component, are used widely to provide yielding support for the hanging wall of the stope. Conventionally, elongate props are cut to length to suit the stope width and are then installed normal to the reef plane. A wedge or headboard is hammered between the upper end of the prop and the hanging wall. This serves to wedge the prop in position but applies very little axial preload force to the prop.

A more substantial preload force is desirable since a prop which is already compressively stressed is in a better state to accept the substantial loads imposed by the hanging wall.

It has already been proposed to preload an elongate prop by placing a bag on a headboard on top of the prop, inflating the bag with a settable grout so that the bag presses on the hanging wall and applies an axial compressive force to the prop, and allowing the grout to set to maintain the applied force.

It is an object of this invention to provide a headboard suitable for supporting the bag.

SUMMARY OF THE INVENTION

According to the present invention there is provided a prop headboard for an elongate prop, the headboard being dimensioned to support a preload bag inflatable with a settable grout, the headboard comprising:

a headboard member which includes a pressed metal sheet having relatively higher end regions and a relatively lower central region which is formed with an opening therein and which is situated between the end regions, the headboard member furthermore including bag retaining formations which extend and which are shaped to receive opposite ends of a preload bag located in use upon the headboard member, an open-ended pot which is engaged or engagable in the opening in the central region and which is dimensioned to receive the upper end of an elongate prop, thereby to support the headboard member on the prop with the headboard member extending transversely to the prop.

In the preferred embodiment, the bag restraining formations are in the form of flexible metal flaps which are fixed to, and extend over, the end regions of the headboard member.

The pot may be releasably engagable in the opening in the central region of the headboard member so as to be interchangeable with other pots dimensioned to receive the upper ends of props of different diameter.

The pot conveniently has a base which serves in use to support a middle region of the preload bag when the preload bag is placed on the headboard member.

BRIEF DESCRIPTION OF THE DRAWINGS

The invention will now be described in more detail, by way of example only, with reference to the accompanying drawings in which.

DESCRIPTION OF AN EMBODIMENT

Figure 1:
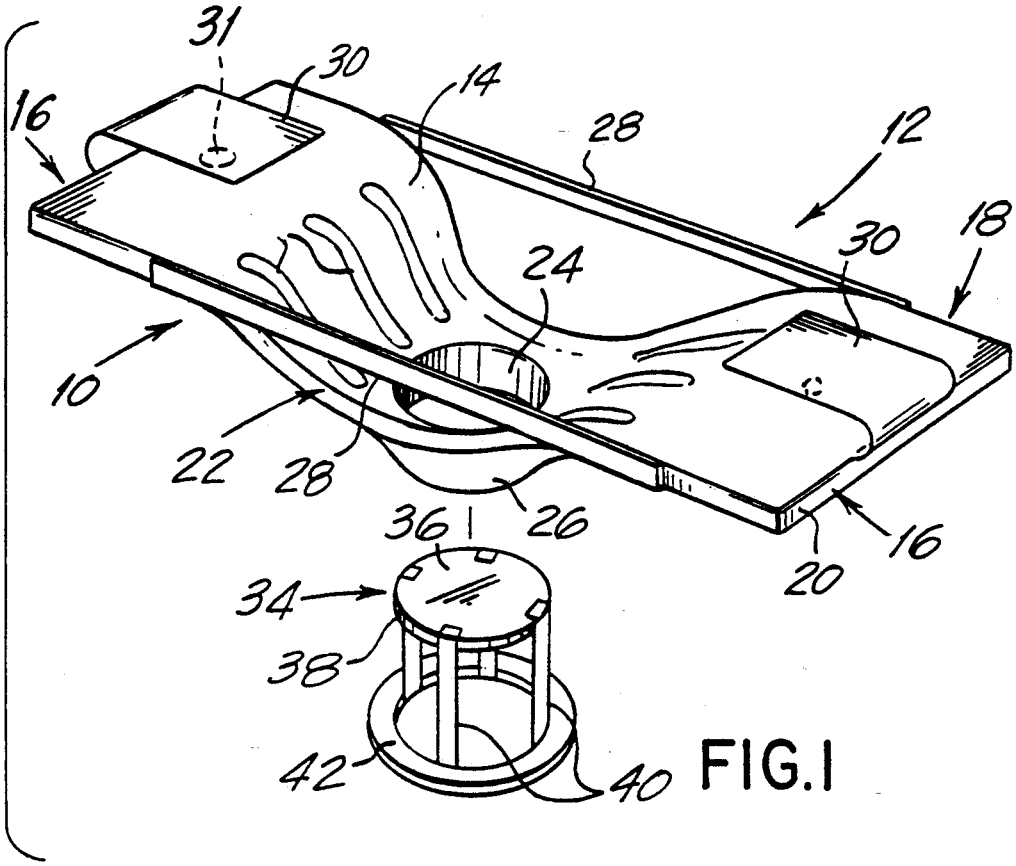
FIG. 1 shows an exploded perspective view of a prop headboard of the invention.

The preload headboard of the invention, designated generally with the numeral 10 in FIG. 1, has two main components. These are a sheet metal, typically steel headboard member 12 and a pot 34.

The member 12 includes a steel sheet 14 which is pressed and stamped to the illustrated configuration. The end edges 16 and the side edges 18 of the sheet 14 are provided with downturned lips 20 to provide added bending strength. The central region 22 of the sheet 14 is in the form of a fairly deep depression which curves downwardly to a central round hole 24 circumscribed by a downwardly extending lip 26.

Reinforcing elements 28 span lengthwise between the side edges 18 of the sheet 14, over the central region 22. These elements are in the form of flat steel bars spot-welded or otherwise fixed to the side edges 18 as illustrated. In addition flexible, thin gauge steel flaps 30 are spot-welded or otherwise fixed to the end edges 16 of the sheet 14. As illustrated, the flaps 30 curve inwardly over the end regions of the sheet 14.

During the pressing of the sheet 14, relieved ribs 32 are provided to enhance the rigidity and bending resistance of the final structure. Holes 31 are formed near to both ends as illustrated.

The pot 34 has a circular metal base plate 36 with a peripheral lip 38. Slender metal flat bars 40 are bent at right angles over the edge of the base plate 36 and spot-welded or otherwise fixed in position as illustrated. The lower ends of the flat bars 40 are bent at right angles beneath an annular metal flange 42 and spot-welded or otherwise fixed in position. The bars 40 lie on a circle which has a diameter less than that of the hole 24, while the outer diameter of the flange 42 is greater than that of the hole.

The inner diameter described by the bars 40 is slightly greater than the diameter of a timber prop 44 for which the headboard 10 is designed. As a first step in the installation of the headboard, the pot 34 is slipped upwardly through the hole 24 until the flange 42 butts up against the lip 26 circumscribing the hole. Then the upper end of the prop 44 is slipped into the pot 34 until it bottoms out on the base plate 36. The pot therefore supports the metal sheet member 12 at the upper end of the prop.

Figure 2:
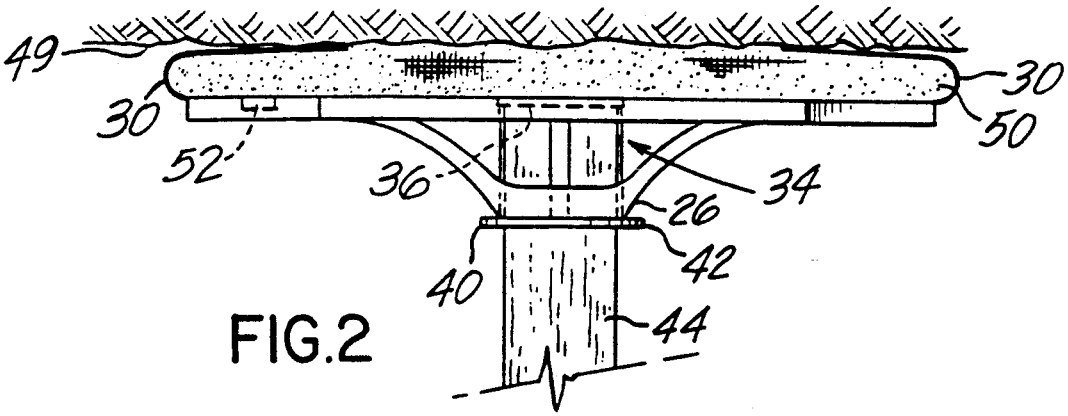
FIG. 2 shows a side view of the headboard in use.
Figure 3:
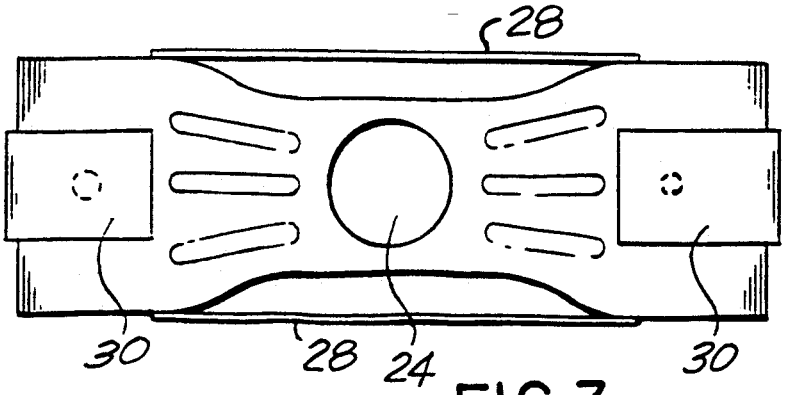
FIG. 3 shows a plan view of the metal sheet member of the headboard.

With the prop in position between a footwall (not shown) and a hanging wall 49 (FIG. 2), and with the headboard 10 in position on the upper end of the prop, an inflatable bag 50 of rectangular shape in plan view is located on the metal sheet 14 with its end edges beneath the flaps 30. It will be noted in FIG. 2 that the end regions of the bag 50 are supported by the metal sheet 14 and that the middle region of the bag is supported by the base plate 36.

The bag itself may be of a known design under the trade mark PROPSETTER. The bag is fluid impervious and has a one way filler nozzle 52 through which it can be charged with a settable cementitious grout by means of a suitable grout pump. In practice, the nozzle will extend through the relevant hole 31 so as to be accessible from below the headboard 10.

As the grout inflates the bag, the bag expands into contact with the hanging wall 49. With a suitable pumping or inflation pressure, an axial compressive force is applied to the prop 44 to preload it. After the desired preload force has been attained, the grout is allowed to set to maintain the applied preload on the prop 44. The applied preload force renders the prop immediately capable of assuming large compressive loading from the hanging wall.

Thereafter, as the hanging wall closes on the footwall, i.e. as the hanging wall descends, the prop, headboard and preload bag act as a composite support for the hanging wall. The timber of the prop is nevertheless capable of yielding axially under compressive loading of sufficiently large magnitude to accommodate the closure of the hanging wall.

The flaps 30 serve a number of important functions. Firstly, they ensure correct lengthways positioning of the bag on the headboard 10. Secondly, the prevent the bag from moving lengthways relative to the headboard 10 as compressive load is applied during inflation of the bag 50, and thereafter. Thirdly, if the prop 44 is not perpendicular to the hanging wall, with the result that it tends to skew as the initial preload and the subsequent compressive load is applied, the bag is prevented from rolling out relative to the headboard 10.

The reinforcing elements 28 prevent the end regions of the metal sheet 14 from splaying apart as load is applied. In addition, they prevent, to some extent at least, any tendency of the bag to move sideways relative to the headboard.

The fact that the pot 34 is a separate component from the sheet member 12 is also advantageous. This feature allows the pot to be interchanged with another pot when a different diameter of prop is to be used. For instance, with a prop of smaller diameter than that illustrated, a pot with a correspondingly smaller inner diameter is used. Of course, the outer diameter of the flange 42 must in all cases remain larger than the diameter of the hole 24.

The feature of pot interchangeability means that the same headboard member 12 can be used with a wide range of elongate props, with the necessity only for a range of different pots 34 to cater for different prop diameters.

The above description refers to a timber prop 44, but it will be appreciated that the prop need not be timber or timber-based in all cases. It is anticipated that the illustrated preload headboard could also be used with conventional temporary metal props, such as those of telescopic type.

The illustrated configuration of the headboard member 12 enables it to be stacked compactly with other similar headboards during transportation and storage. Stacking takes place with the central region 22 of one member 12 nesting snugly in the central region 22 of the member 12 below and with the elements 28 resting one on top of the other.

I claim:

1. A headboard for an elongate prop, the headboard being dimensioned to support a preload bag inflatable with a settable grout, the headboard comprising:

a pressed steel sheet support member which has a substantially rectangular shape in plan view and which has relatively higher end regions lying in a common plane and a relatively lower central region which is formed with an opening therein and which is situated between the end regions, bag retaining formations which are in the form of flexible steel flaps connected to opposite ends of the support member and extend inwardly over the end regions of the support member, the flaps being shaped to locate over opposite ends of a preload bag located in use upon the support member, and an open-ended pot which is releasably engagable at an inverted orientation, in the opening in the central region, the pot being dimensioned to receive the upper end of an elongate prop and having a base against which the end of the prop bears when fully received by the pot, the base lying in substantially the same plane as the end regions of the support member, so that the support member is supported transversely on the end of the prop with the base of the pot and the end regions of the support member providing support for a preload bag placed on the support member with its ends located beneath the flaps.

2. A prop headboard according to claim 1 wherein the pot is interchangeable with other pots dimensioned to receive the upper ends of props of different diameter.

3. A prop headboard according to claim 1 wherein the end regions of the support member and the opening in the central region are bounded by downturn lips.

4. A prop headboard according to claim 3 wherein the end regions of the support member are formed with holes to receive a filler nozzle of a preload bag.

5. A prop headboard according to claim 4 wherein the end regions of the support member are tied to one another by reinforcing elements spanning over the central region.

6. A prop headboard according to claim 5 wherein the support member is shaped to stack with another similar support member with the central region of the support member nesting in the central region of the other support member and with the reinforcing elements of the support member resting on the corresponding reinforcing elements of the other support member.

* * * * *